US008517040B2

(12) United States Patent
Doughty

(10) Patent No.: US 8,517,040 B2
(45) Date of Patent: Aug. 27, 2013

(54) VALVE CONTROL OF PUMP INLET PRESSURE WITH BOOTSTRAP RESERVOIR

(75) Inventor: Kurt J. Doughty, Berlin, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 26 days.

(21) Appl. No.: 13/208,501

(22) Filed: Aug. 12, 2011

(65) Prior Publication Data

US 2013/0037119 A1 Feb. 14, 2013

(51) Int. Cl.
*F15B 1/26* (2006.01)

(52) U.S. Cl.
USPC ..... 137/12; 137/563; 137/565.13; 417/540

(58) Field of Classification Search
USPC ..... 137/563, 565.13, 565.34, 12, 14; 417/279, 295, 297, 540
See application file for complete search history.

(56) References Cited

U.S. PATENT DOCUMENTS 1,663,647 A * 3/1928 Brush ..... 417/295
4,077,746 A 3/1978 Reynolds
4,187,682 A 2/1980 Shen
4,376,619 A 3/1983 Haushalter et al.
4,538,972 A 9/1985 Gooden
4,691,739 A * 9/1987 Gooden ..... 417/540
4,906,166 A 3/1990 Seidel
4,991,800 A 2/1991 Schwarz
5,020,322 A 6/1991 Schwarz
5,231,846 A * 8/1993 Goshaw et al. ..... 62/175
5,305,604 A 4/1994 Phillips
6,109,886 A * 8/2000 Schonfeld et al. ..... 417/306
6,241,485 B1 * 6/2001 Warwick ..... 417/300
6,547,862 B2 4/2003 Dean
6,652,240 B2 * 11/2003 Wichert ..... 137/487.5
2010/0288369 A1 * 11/2010 Chang et al. ..... 137/565.16
2011/0000202 A1 1/2011 Gronli

* cited by examiner

*Primary Examiner* — John Rivell

(74) *Attorney, Agent, or Firm* — Carlson, Gaskey & Olds, P.C.

(57) ABSTRACT

A closed-loop system includes a pump driving a fluid through a series of conduits. A control system is included that minimizes pressure fluctuations in a bootstrap reservoir to maintain a desired minimum pressure at the pump inlet. Moreover, the control system reduces a maximum system pressure by reducing the magnitude of pressure fluctuations encountered by the bootstrap reservoir.

17 Claims, 4 Drawing Sheets

VALVE CONTROL OF PUMP INLET PRESSURE WITH BOOTSTRAP RESERVOIR

BACKGROUND

This disclosure generally relates to a reservoir for a hydraulic system. More particularly, this disclosure relates to control of fluid pressure to minimize a maximum pump inlet pressure.

A closed-loop hydraulic system includes a pump that drives fluid through the system. A reservoir is provided within the system to accommodate changes in the working fluid due to thermal expansion and contraction along with other variables. A bootstrap reservoir includes a piston movable between a high pressure chamber and a low pressure chamber to maintain a desired minimum pump inlet pressure. The minimum fluid pressure at an inlet to the pump is desired to provide efficient operation of the pump. A fluid pressure that is lower than desired can adversely affect pump operation and durability. Accordingly, a minimum pressure provided by the bootstrap reservoir is set well above the minimum desired inlet pressures. Because the low end of the pressure range is fixed by the bootstrap reservoir, the high end of the pressure range may be higher than desired. Higher pressures require that all system components be sufficiently robust to perform at the higher pressures. Accordingly, components in the fluid system are designed to withstand higher pressures that results in increased cost and weight.

SUMMARY

A disclosed closed loop fluid system includes a pump for pumping fluid at a desired pressure and flow to hydraulically operated devices such as valves or other hydraulic actuators, or devices which exchange heat with the system fluid such as heat exchangers or electronic motor controllers. Volume fluctuations within the system are compensated by a bootstrap reservoir. A control system is included that minimizes pressure fluctuations in the bootstrap reservoir to maintain a desired minimum pressure at the pump inlet. Moreover, the control system reduces a maximum system pressure by reducing the magnitude of pressure fluctuations encountered by the bootstrap reservoir.

The control system includes a pressure sensor, controller and valve. The pressure sensor measures pressure indicative of pressure at the inlet of the pump. Measurements from the pressure sensor are utilized to drive and operate the control valve. The control valve modulates pressure within the system to minimize the effects of fluid pressure drops caused by the device on the bootstrap reservoir. The reduction in pressure fluctuations provides for a lower upper pressure limit, and thereby reduces overall system and component requirements.

These and other features disclosed herein can be best understood from the following specification and drawings, the following of which is a brief description.

DETAILED DESCRIPTION

Figure 1:
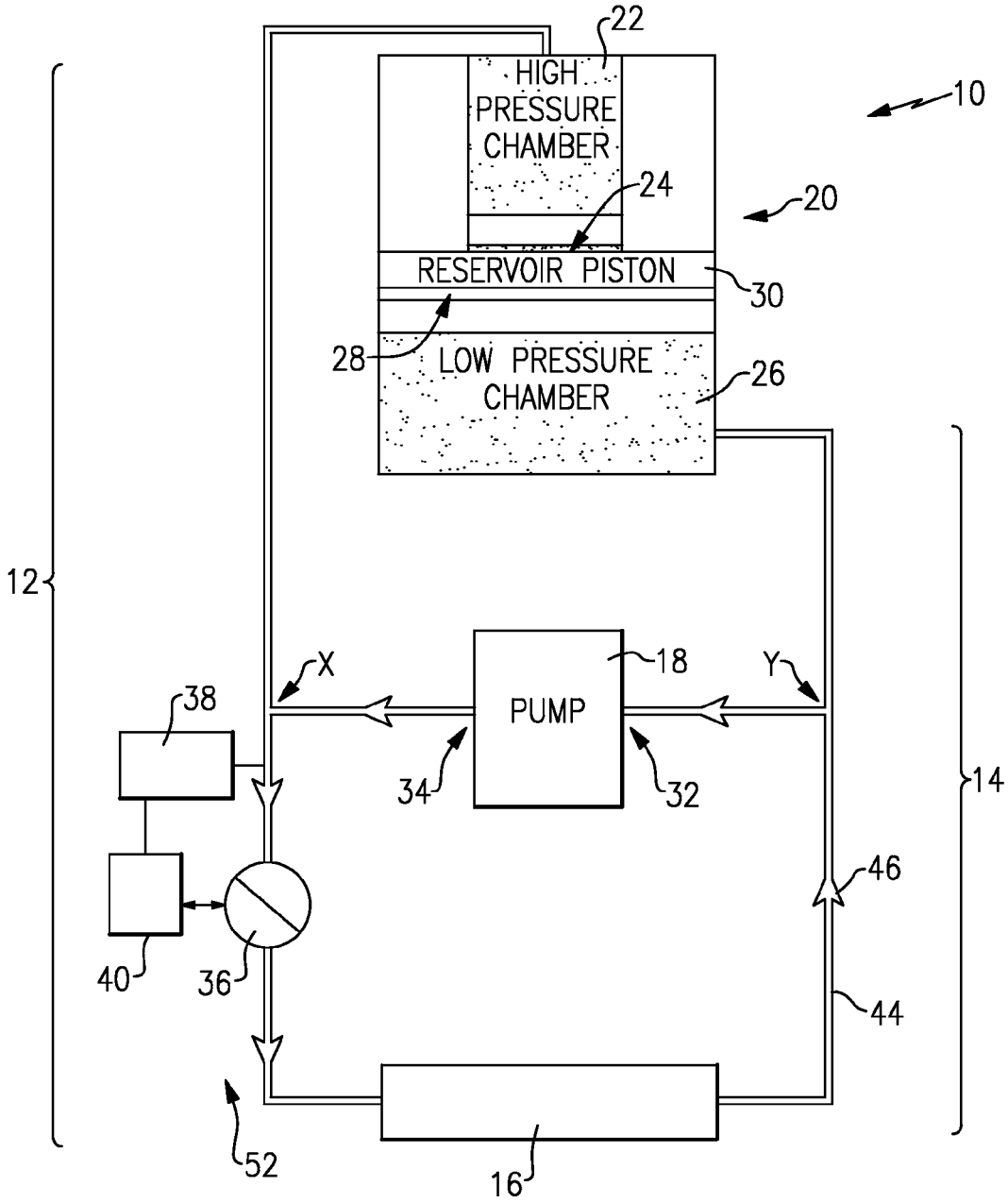
FIG. 1 is a schematic representation of a closed loop fluid system including a bootstrap reservoir and a valve for controlling a pressure drop within the system.

Referring to FIG. 1, an example closed loop system 10 includes a high pressure portion 12 and a low pressure portion 14. Fluid flow 46 proceeds through the closed loop system through a plurality of conduits 44. Conduits 44 communicate fluid pressure to a device or devices schematically indicated at 16. The device 16 represents hydraulically operated devices such as valves, other hydraulic actuators or devices which exchange heat with the system fluid such as heat exchangers or electronic motor controllers that require fluid flow at a desired pressure within the closed loop system 10.

A pump 18 drives a fluid flow through the conduits 44 of the closed loop system 10 and includes an inlet 32 and an outlet 34. Fluid pressure at the inlet 32 is maintained above a minimum desired operating pressure. The desired operating pressure at the pump 18 is set to a minimum level. As appreciated, if the fluid pressure at the inlet 32 drops below a minimum pressure, cavitation can occur within the pump 18 that causes a degraded operating capacity.

Accordingly, in the example closed loop system 10, a bootstrap reservoir 20 is set parallel to the pump 18 to maintain a minimum pressure at the pump inlet 32. The example bootstrap reservoir 20 includes a high pressure chamber 22 and a low pressure chamber 26. The high pressure chamber 22 and the low pressure chamber 26 are separated by a piston 30. A piston 30 moves responsive to system volume change and differential pressures within the high pressure chamber 22 and the low pressure chamber 26.

An area 24 of the high pressure chamber 22 is different than an area 28 of the low pressure chamber 26. The difference in area provides the balance of the high pressure chamber 22 and the low pressure chamber 26 that sets a minimum pressure level for fluid pressure within the conduits 44 of the closed loop system 10. In order to maintain a desired minimum operating pressure within the system, the areas 24 and 28 are balanced to provide the desired minimum fluid pressure in view of operation of the device 16. The bootstrap reservoir 20 further adjusts pressure within the system 10 to accommodate changes in the working fluid encountered during operation. Such changes can include thermal expansion and contraction along with losses due to leakage or other operational functions.

The example bootstrap reservoir 20 is designed with a desired ratio by varying the ratio of an area 24 of the piston 30 acted on by fluid in the high pressure chamber 22 with an area 28 acted on by the low pressure chamber 26. The specific ratio between the high pressure area 24 and the low pressure area 28 sets the minimum desired pressure at the pump inlet 32.

The pressure at the high pressure chamber 22 of the bootstrap reservoir 20 fluctuates in direct proportion to the system pressure. Therefore pressure changes encountered due to operation of the device 16 are translated to changes in pressure in the high pressure chamber 22 of the bootstrap reservoir 20. Changes in the high pressure chamber 22 result in a wide range of corresponding pressures in the lower pressure chamber 26 of the bootstrap reservoir 20. In turn, pressure within the low pressure region 14 and at the pump inlet 32 falls within a wide range. For this reason, the bootstrap reservoir 20 is designed to satisfy the minimum operating pressures for the inlet 32 under all operating conditions, including the lowest pressure drops. This results in an overall higher system operating pressure during normal conditions to compensate for the lowest pressure drops.

In the example closed loop system 10 shown in FIG. 1, a control system 52 is provided that includes a pressure sensor 38, controller 40 and valve 36. The pressure sensor 38 is disposed within the conduits 44 to obtain a pressure measurement indicative of pressure at the inlet 32 of the pump 18. Measurements of the pressure within the conduits 44 are utilized to drive and operate the control valve 36. The control valve 36 modulates pressure within the system 10 and specifically within the high pressure chamber 22 to minimize the effects of fluid pressure drops caused by the device 16. Because the valve 36 controls pressure drops within the system 10, a range of pressure fluctuations in the high pressure chamber 22 is reduced. The reduction in pressure fluctuations further provides for a lower upper pressure limit, and thereby reduces overall system and component requirements. In other words, system components can be designed lighter in view of the lower upper pressure limits.

In the example closed loop system 10, the valve 36 is modulated by a controller 40 in response to a pressure measured by the pressure sensor 38. Modulation of the valve 36 varies the pressure drop between node X and node Y which provides for control of pressure within the low pressure chamber 26 and therefore control of pressure at pump inlet 32 in response to varying pressure drops produced by actuation and operation of the device 16.

The example valve 36 can comprise a variable orifice valve that changes the flow area in order to control pressure drops within the system and at the low pressure chamber 26 of the reservoir 20. The valve 36 may also be an on/off valve that is modulated between open positions and closed positions to limit the range of pressures encountered at the bootstrap reservoir 20.

In operation, the pump 18 outputs fluid at desired flow and pressure through the outlet 34. Fluid pressure and flow is communicated from the pump 18 to both the high pressure chamber 22 of the bootstrap reservoir 20 and the device 16. The valve 36 is disposed between the device 16 and the pump 18. In the event of a pressure drop caused by actuation of the device 16, the pressure sensor 38 will communicate the change in pressure to a controller 40. The controller 40 commands the valve 36 to move to a more closed position to minimize the effects of pressure drops within the high pressure portion 12 of the system 10. Closing of the valve 36 reduces the impact the pressure drop experienced behind the valve caused by actuation and operation of the device 16 such that the high pressure chamber 22 and low pressure chamber 26 do not experience a large drop in pressure. The valve 36 reduces the effect of varying pressure drops of the device 16 on the system and particularly on the pump inlet 32.

The reduced range of pressure drops between node X and node Y provides a corresponding reduction in a range of pressures encountered in the low pressure region 14 and thereby at the pump inlet 32. In response to an increase in pressure drop caused, for example by the closing of valves of the device 16, the controller 40 will command the valve 36 to move to a more open condition to reduce pressure within the high pressure chamber 22.

Figure 2:
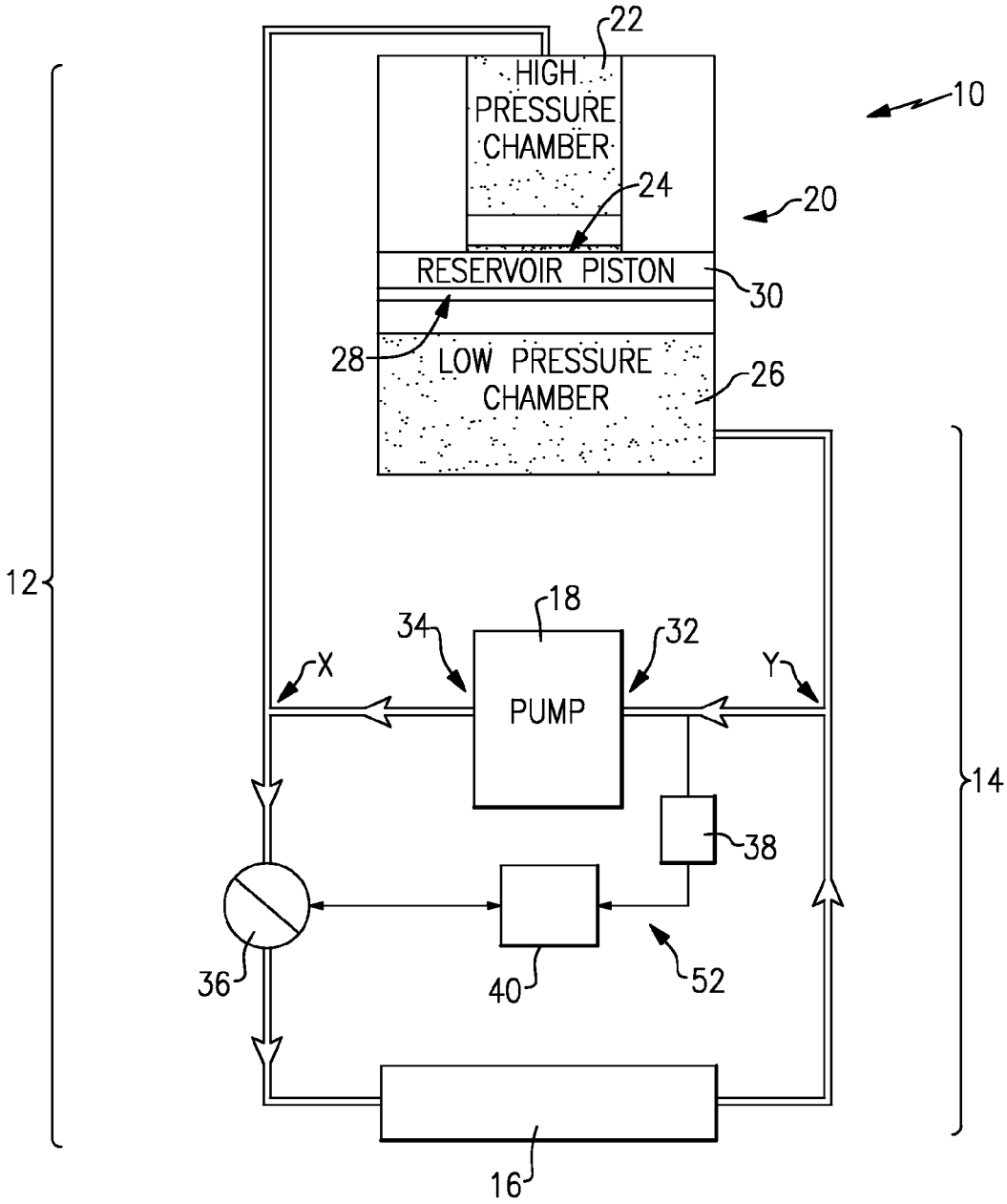
FIG. 2 is another schematic representation of a closed loop fluid system including a bootstrap reservoir and valve for controlling pressure drop within the system.

Referring to FIG. 2, another example closed loop system 10 includes the bootstrap reservoir 20 disposed in parallel with the pump 18. In this example the pressure sensor 38 is disposed close to or directly at the inlet 32 of the pump 18. This position provides an accurate representation of pressure at the inlet of the pump 18. Pressure measurements from the pressure sensor 38 are communicated to the controller 40 that then drives the valve 36 to the desired position to maintain minimum pressure at the pump inlet 32 resulting in minimum pressure within the system 10. As appreciated, providing the pressure sensor 38 at the pump inlet 32 provides a direct indication of the desired minimum pressure without any interpretation or extrapolation.

Figure 3:
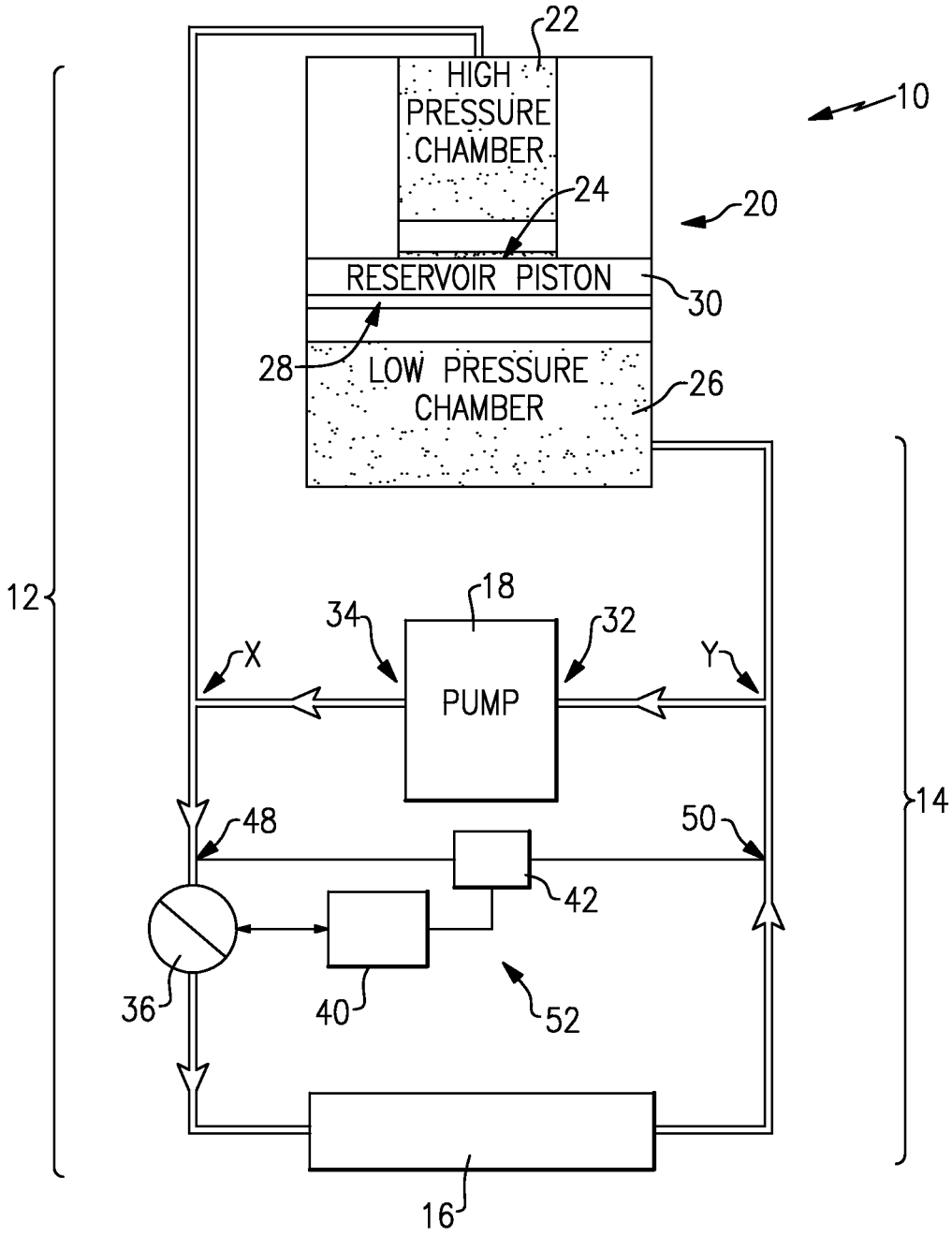
FIG. 3 is yet another schematic representation of a closed loop fluid system that includes a valve for controlling a pressure within the system.

Referring to FIG. 3, another example closed loop system 10 includes the bootstrap reservoir 20 disposed in parallel with the pump 18 and a differential pressure sensor 42 that measures pressure at at least two different locations 48,50 within the system 10. In this example the pressure sensor 42 is measuring pressure at a first point 50 in the low pressure portion 14 and at a second point 48 in the high pressure portion 12 of the closed loop system 10. The controller 40 obtains the differential pressure provided by the pressure sensor 42 controls the valve 36 to provide the desired opening required to maintain a desired pressure at the pump inlet 32. The differential pressure reading can be used to provide additional data indicative of pressure differentials within the system 10. The differential pressure measurements are communicated to the controller 40 that thereby commands the valve 36 to provide a desired pressure drop within the system 10 that maintains a minimum level of pressure at the pump inlet 32.

Figure 4:
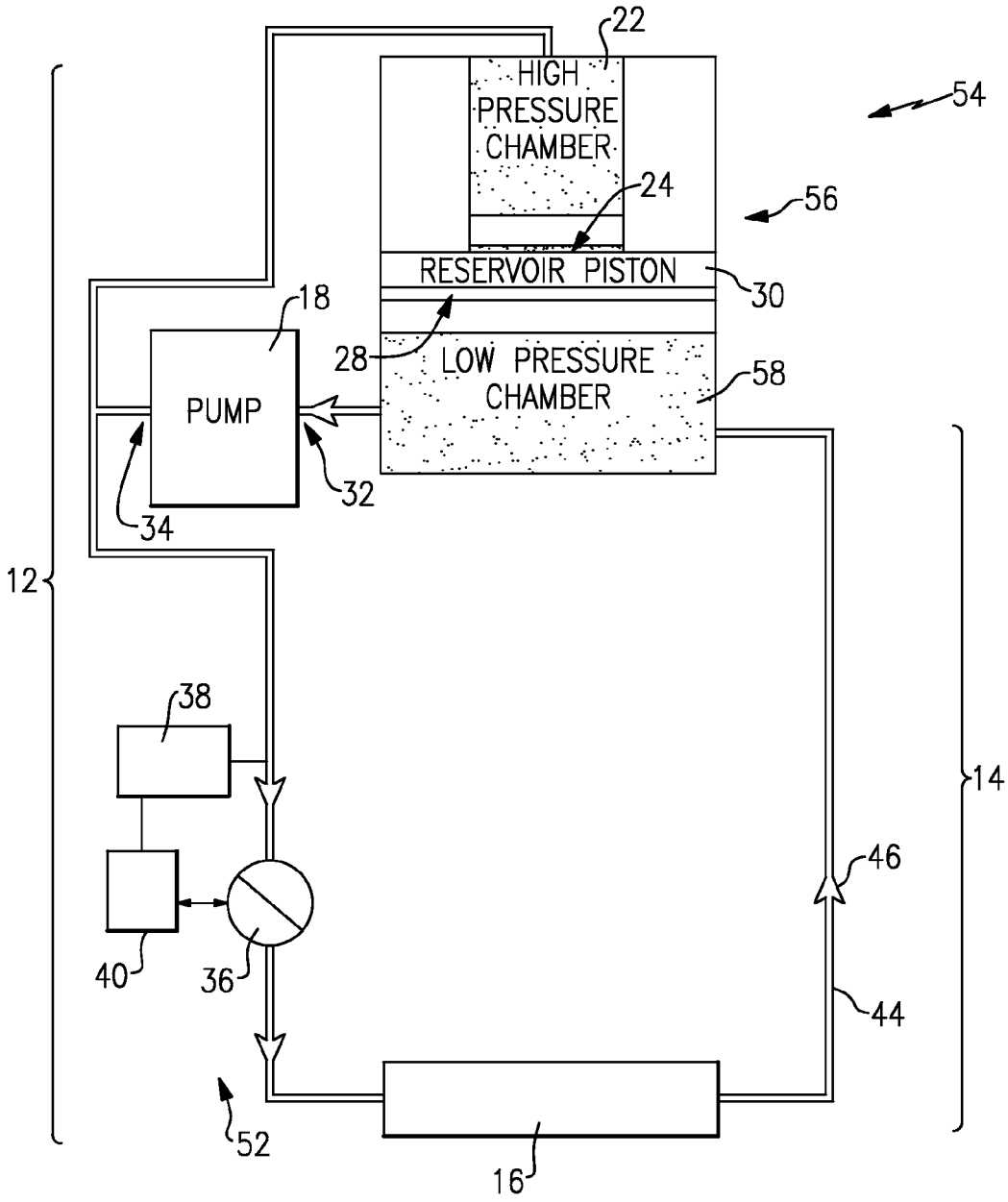
FIG. 4 is another schematic representation of a closed loop fluid system that includes a portion of a bootstrap reservoir in series with a pump.

Referring to FIG. 4, an example closed loop system 54 includes a bootstrap reservoir 56 with a high pressure chamber 22 and a low pressure chamber 58. In this example, the low pressure chamber 58 is disposed in series with the pump 18. The in series configuration provides a flow through low pressure chamber 58. It is also within the contemplation of this disclosure that the high pressure chamber 22 may also be arranged in series with the pump 18. Moreover, both or just one of the high pressure chamber 22 and the low pressure chamber 58 may be disposed in series with the pump 18 as may be desired to meet application specific requirements.

Accordingly, the example system provides for the minimizing of pressure variations within a closed loop system and thereby provides for a reduction in overall system maximum design operating pressure.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A closed-loop system comprising:

a pump driving a fluid through a series of conduits, the pump including pump inlet receiving fluid from within the series of conduits and pump outlet;

a reservoir in fluid communication with the series of conduits, the reservoir including a high pressure chamber in communication with the pump outlet and a low pressure chamber separated by a piston from the high pressure chamber and in communication with the pump inlet, the piston movable responsive to a pressure differential between the high pressure chamber and the low pressure chamber;

a hydraulic device operating responsive to fluid flow through the conduits of the system, wherein the device generates pressure variations within the system during operation utilizing fluid provided from the pump outlet and exhausting fluid through the series of conduits back to the pump inlet and the low pressure chamber of the reservoir;

a pressure sensor sensing a pressure within the system indicative of pressure at the inlet of the pump; and a valve disposed within the series of conduits between the pump outlet and the hydraulic device for regulating a pressure difference between the high pressure chamber and the low pressure chamber responsive to a change in pressure demand by the hydraulic device to minimize a pressure range of the system.

2. The closed-loop system as recited in claim 1, wherein the pressure sensor is disposed proximate the inlet to the pump.

3. The closed-loop system as recited in claim 1, wherein the valve comprises a variable orifice for controlling a pressure drop between the inlet, outlet and the resulting pressure encountered by the high pressure chamber of the reservoir.

4. The closed-loop system as recited in claim 1, wherein the valve comprises a shut-off valve modulated responsive to a pressure measured by the pressure sensor to maintain a desired fluid pressure at the inlet to the pump.

5. The closed-loop system as recited in claim 1, wherein the reservoir is disposed parallel with the pump within the system.

6. The closed-loop system as recited in claim 1, wherein the pressure sensor comprises a differential pressure sensor sensing fluid pressure in at least two locations within the system.

7. The closed-loop system as recited in claim 1, wherein the minimum pressure comprise a pressure determined to prevent cavitation within the pump.

8. The closed-loop system as recited in claim 1, wherein the pressure sensor is disposed at the outlet of the pump.

9. A method of controlling a pressure within a closed-loop system comprising:

detecting a fluid pressure indicative of a fluid pressure at an inlet to a fluid pump;

accommodating changes in fluid pressure within the closed-loop system with a bootstrap reservoir; and controlling a pressure drop at the bootstrap reservoir to minimize a maximum fluid pressure within the closed-loop system with a valve disposed between an inlet of a high pressure chamber of the bootstrap reservoir and a hydraulic device disposed within the closed-loop system.

10. The method as recited in claim 9, wherein the reservoir includes a high pressure chamber separated from a low pressure chamber by a piston, wherein a high pressure piston area corresponds with a low pressure piston area to set a minimum fluid pressure at the inlet to the fluid pump.

11. The method as recited in claim 9, including modulating a valve to control changes in fluid pressure at the reservoir.

12. The method as recited in claim 9, including measuring a pressure differential within the system and controlling a valve responsive to the measured pressure differential.

13. The method as recited in claim 9, including controlling a variable orifice of a valve responsive to the measured pressure for adjusting a pressure encountered at the reservoir.

14. A control system of a closed-loop fluid system, the control system comprising:

a reservoir including a high pressure chamber in fluid communication with a high pressure portion of the closed-loop fluid system and a low pressure chamber in fluid communication with a low pressure portion of the closed loop fluid system;

a sensor for measuring a fluid pressure indicative of a fluid pressure at an inlet of a pump;

a valve operable for controlling a pressure differential between the high pressure chamber and the low pressure chamber; and a controller governing operation of the valve responsive to the measured fluid pressure for maintaining a desired fluid pressure at the inlet of the pump within a desired operating range by adjusting the valve to maintain a pressure differential between the high pressure chamber and the low pressure chamber responsive to fluctuations in the closed-loop system caused by a hydraulic device in the closed loop system.

15. The control system as recited in claim 14, wherein the valve comprises an on/off valve modulated to provide a desired pressure drop.

16. The control system as recited in claim 14, wherein the valve comprises a variable orifice controlled to provide a desired pressure drop.

17. The control system as recited in claim 14, wherein the sensor comprises a differential pressure sensor measuring pressure in at least two locations within the closed-loop fluid system.

* * * * *

UNITED STATES PATENT AND TRADEMARK OFFICE

CERTIFICATE OF CORRECTION

PATENT NO. : 8,517,040 B2
APPLICATION NO. : 13/208501
DATED : August 27, 2013
INVENTOR(S) : Doughty It is certified that error appears in the above-identified patent and that said Letters Patent is hereby corrected as shown below:

IN THE CLAIMS:

Claim 10, column 5, line 41: “a” should read as --the--

Signed and Sealed this
Sixth Day of May, 2014

Michelle K. Lee

Michelle K. Lee
*Deputy Director of the United States Patent and Trademark Office*